United States Patent [19]

Kashiwagi

[11] Patent Number: 5,073,053

[45] Date of Patent: Dec. 17, 1991

[54] COLOR DISCRIMINATION APPARATUS FOR COLOR INK RIBBON

[75] Inventor: Shinichi Kashiwagi, Shizuoka, Japan

[73] Assignee: Tokyo Electric Co., Ltd., Tokyo, Japan

[21] Appl. No.: 488,862

[22] Filed: Mar. 5, 1990

[30] Foreign Application Priority Data

Mar. 6, 1989 [JP] Japan ..... 1-53206

[51] Int. Cl.[5] ..... B41J 31/09

[52] U.S. Cl. ..... 400/240.3; 400/708; 400/240.4; 250/548

[58] Field of Search ..... 400/240.3, 240.4, 237, 400/120, 308; 250/548, 202; 356/400; 358/482, 75

[56] References Cited

U.S. PATENT DOCUMENTS

| | | | |
|---|---|---|---|
| 3,513,320 | 5/1970 | Weldon | 250/548 |
| 3,559,568 | 2/1971 | Stanley | 250/548 |
| 4,401,390 | 8/1983 | Melissa et al. | 400/240.3 |
| 4,558,329 | 12/1985 | Honda | 250/548 |
| 4,573,059 | 2/1986 | Shinma et al. | 250/548 |
| 4,652,154 | 3/1987 | Horiya et al. . | |
| 4,728,800 | 3/1988 | Surka | 250/548 |
| 4,767,933 | 8/1988 | French et al. | 250/548 |
| 4,771,296 | 9/1988 | Shimada et al. | 400/240.3 |
| 4,910,533 | 3/1990 | Sasaki et al. | 400/240.4 |

FOREIGN PATENT DOCUMENTS

| | | | |
|---|---|---|---|
| 3518585 | 11/1985 | Fed. Rep. of Germany . | |
| 0136283 | 8/1984 | Japan | 400/240.4 |
| 0150781 | 8/1984 | Japan | 400/240.3 |
| 0171680 | 9/1984 | Japan | 400/240.4 |
| 0073888 | 4/1985 | Japan | 400/240.4 |
| 0139476 | 7/1985 | Japan | 400/240.3 |
| 0180883 | 9/1985 | Japan | 400/240.4 |
| 0242090 | 12/1985 | Japan | 400/237 |
| 0084274 | 4/1986 | Japan | 400/240.3 |
| 0132375 | 6/1986 | Japan | 400/240.3 |
| 0092883 | 4/1987 | Japan | 400/237 |
| 0049472 | 3/1988 | Japan | 400/237 |
| 2100673 | 1/1983 | United Kingdom . | |

OTHER PUBLICATIONS

Patent Abstracts of Japan, unexamined applications, M. Field, vol. 10, No. 21, Jan. 28, 1986.

The Patent Office Japanese Government, p. 164 M 449 Kokai-No. 60-180 883 (Mitsubishi).

*Primary Examiner*—Eugene H. Eickholt

*Attorney, Agent, or Firm*—Oblon, Spivak, McClelland, Maier & Neustadt

[57] ABSTRACT

In the present invention, a long and narrow color ink ribbon in which ink supply portions are repeatedly formed with the same arrangement is formed, a ribbon carrying means which moves the color ink ribbon in its lengthwise direction is provided, positions discriminating marks which are parallel to the lengthwise direction of the color ink ribbon and of which lengths are set correspondingly to the respective ink supply portions are positioned on the same straight line and formed at one edge of the color ink ribbon, and a discrimination mark read-out means implemented by arranging two optical sensors on a straight line in the direction along which the color ink ribbon moves is provided at the position opposite the discrimination marks.

9 Claims, 6 Drawing Sheets

FIG. 1
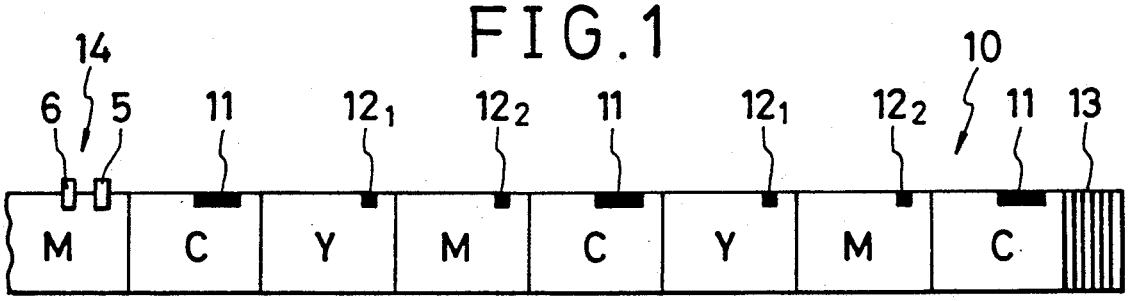
FIG. 2
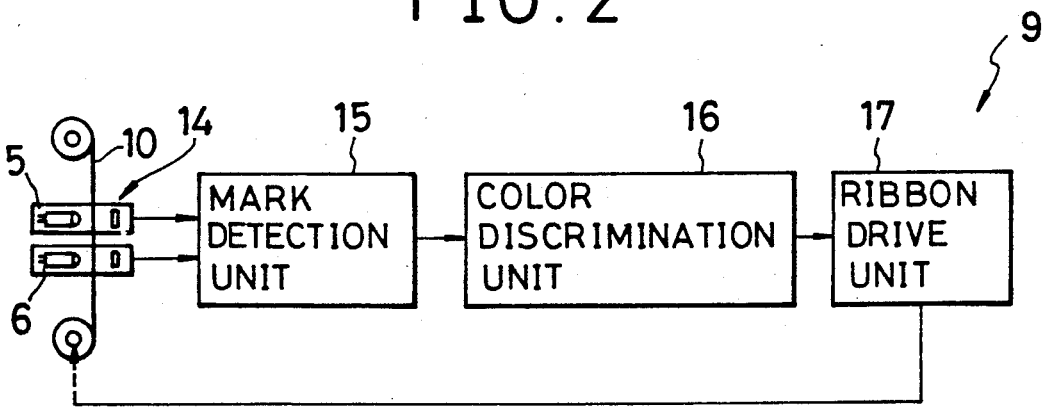
FIG. 3
| CHANGE IN OUTPUT OF OPTICAL SENSOR 6 | COLOR OF INK SUPPLY PORTION TO BE DISCRIMINATED |
|---|---|
| H ⇒ L | Y (YELLOW) |
| L ⇒ H | M (MAZENTA) |
| H ⇒ H | C (CYAN) |

FIG. 6
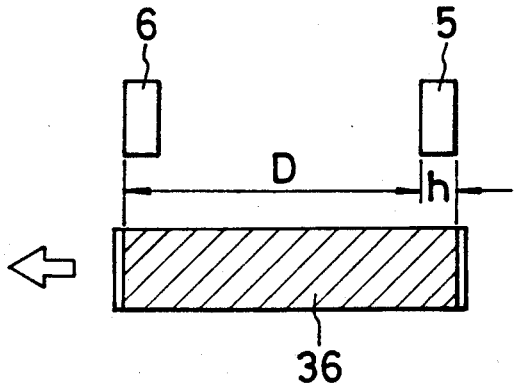
FIG. 7
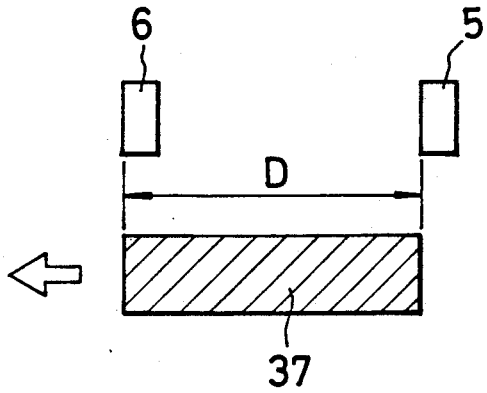
FIG. 8
| CHANGE IN OUTPUT OF OPTICAL SENSOR 6 | COLOR OF INK SUPPLY PORTION TO BE DISCRIMINATED |
|---|---|
| L ⇒ L | Y (YELLOW) |
| H ⇒ L | M (MAZENTA) |
| H ⇒ L | C (CYAN) |

| CHANGE IN OUTPUT OF OPTICAL SENSORS [5 AND 6] | COLOR OF INK SUPPLY PORTION TO BE DISCRIMINATED |
|---|---|
| [L , H] ⇒ [H , L] | Y (YELLOW) |
| [H , L] ⇒ [L , H] | M (MAZENTA) |
| [L , H] ⇒ [L , H] | C (CYAN) |

COLOR DISCRIMINATION APPARATUS FOR COLOR INK RIBBON

FIELD OF THE INVENTION AND RELATED ART STATEMENT

The present invention relates to a color discrimination apparatus for a color ink ribbon utilized in a color printer and the like.

A conventional example of a color discrimination apparatus for color ink ribbon will be described based on FIG. 10 and FIG. 11. At first, a color discrimination apparatus 1 for this color ink ribbon is designed for a color printer. In the lengthwise direction of a long and narrow color ink ribbon 2 of a fixed width, ink supply portions Y, M, and C of Yellow, Magenta, and Cyan are formed repeatedly with the same arrangement, and discrimination marks 3 and 4 composed of black dots are formed on both sides of portions between the respective ink supply portions. Also, this ink ribbon 2 is mounted on a ribbon carrying means (not shown) and carried in a ribbon carrier path (not shown). At the position at which this ribbon carrying path abuts on the above-mentioned ink supply portions Y, M, and C, a line thermal head, that is, a printing head is disposed, and at the position at which this ribbon carrier path is opposite to the above-mentioned discrimination marks 3 and 4, optical sensors 5 and 6 are disposed. These optical sensors 5 and 6 are arranged on a straight line perpendicular to the lengthwise direction of the above-mentioned color ink ribbon 2 and mounted on the both sides of the above-mentioned ribbon carrier path, thereby forming a discrimination mark read-out means 7. Incidentally, a black belt-shaped end mark 8 is formed at the end portion of the above-mentioned color ink ribbon 2.

With such a constitution, in this color discrimination apparatus 1 for this color ink ribbon, the color ink ribbon 2 is carried in its lengthwise direction by the ribbon carrying means, the predetermined ink supply portions Y, M, and C abut on the line thermal head, and respective monochrome picture images are overlappingly printed, thereby forming a color picture image. In this time, in the color discrimination apparatus 1 for this color ink ribbon, as exemplified in FIG. 11, when the respective discrimination marks 3 and 4 pass in front of the optical sensors 5 and 6 as the color ink ribbon 2 moves, the ink supply portions Y, M, and C which abut on the line thermal head are discriminated based on the change in detected values of the optical sensors.

In other words, if the change in the output values of the optical sensors 5 and 6 is [L, H]→[H, L], it is detected that the ink supply portion Y abuts on the line thermal head. Similarly, if the above mentioned change is [H, L]→[L, H] or [L, H]→[L, H], it is detected that the ink supply portion M or C abuts on the line thermal head. Furthermore, in this color discrimination apparatus 1 for a color ink ribbon, when the end mark 8 reaches the discrimination mark read out means 7, the optical sensors 5 and 6 output [L, L], and the ribbon end is detected, thereby stopping devices.

In such the color discrimination apparatus 1 for a color ink ribbon as described above, the end of the color ink ribbon 2 and the colors of the ink supply portions Y, M, and C are discriminated by the change in the output values of the two optical sensors 5 and 6. But, it is, therefore, necessary to form the discrimination marks 3 and 4 at the edges of the both sides of the color ink ribbon 2. The width of the portions which are not employed is, therefore, made wide, which results in the cause that the width of the ink supply portions is made narrow or the width of the color ink ribbon 2 is enlarged. Further, since the optical sensors 5 and 6 are needed to be mounted separately on the both sides of the carrier path of the color ink ribbon 2, assembling works of the color discrimination apparatus 1 for a color ink ribbon are complicated, by which the miniaturization of the devices is hindered. Also, since the optical sensors 5 and 6 are opposed at the both side edges of the color ink ribbon 2, it is necessary to adjust the positions of the both optical sensors 5 and 6 in the case where a color ink ribbon of which width is different from that of a conventional ink ribbon is used.

OBJECT AND SUMMARY OF THE INVENTION

A first object of the present invention is to increase the ratio of the length of the ink supply portion to the total width of the color ink ribbon.

A second object of the present invention is to obtain a color discrimination apparatus which is capable, even if a color ink ribbon has various kinds of sizes in width, of employing the color ink ribbon similarly.

A third object of the present invention is to provide a color discrimination apparatus for a color ink ribbon which is capable of miniaturizing devices.

In the present invention, a long and narrow color ink ribbon in which ink supply portions of respective colors are repeatedly formed with the same arrangement is formed, a ribbon carrying means which moves this color ink ribbon in its lengthwise direction is provided, discrimination marks composed of straight lines which are parallel to the lengthwise direction of the color ink ribbon and of which lengths are set correspondingly to the respective ink supply portions are made to position on the same straight line and formed at one edge of the color ink ribbon, and a discrimination mark read-out means implemented by arranging two optical sensors on a straight line in the direction along which the color ink ribbon moves is provided at the position opposite to the discrimination marks. Accordingly, the discrimination marks composed of straight lines which are parallel to the lengthwise direction of the color ink ribbon and of which lengths are set correspondingly to the respective ink supply portions are made to position on the same straight line and formed at an edge of one side of the color ink botton, and a discrimination mark read-out means implemented by arranging two optical sensors on a straight line in the direction along which the color ink ribbon moves is provided at the position opposite to the discrimination marks, thereby allowing the colors of the ink supply portions to be exactly discriminated by utilizing the change in the output of the discrimination mark read-out means and the like.

BRIEF DESCRIPTION OF THE DRAWINGS

FIG. 1 is an explanatory diagram showing a first embodiment according to the present invention.

FIG. 2 is a block diagram.

FIG. 3 is an explanatory diagram of a read-out operation.

FIG. 6 and FIG. 7 each are an explanatory diagram of the relationship between optical sensors and discrimination marks, which shows a second embodiment.

FIG. 8 is an explanatory diagram of read-out operation.

DETAILED DESCRIPTION OF PREFERRED EMBODIMENTS

Figure 4:
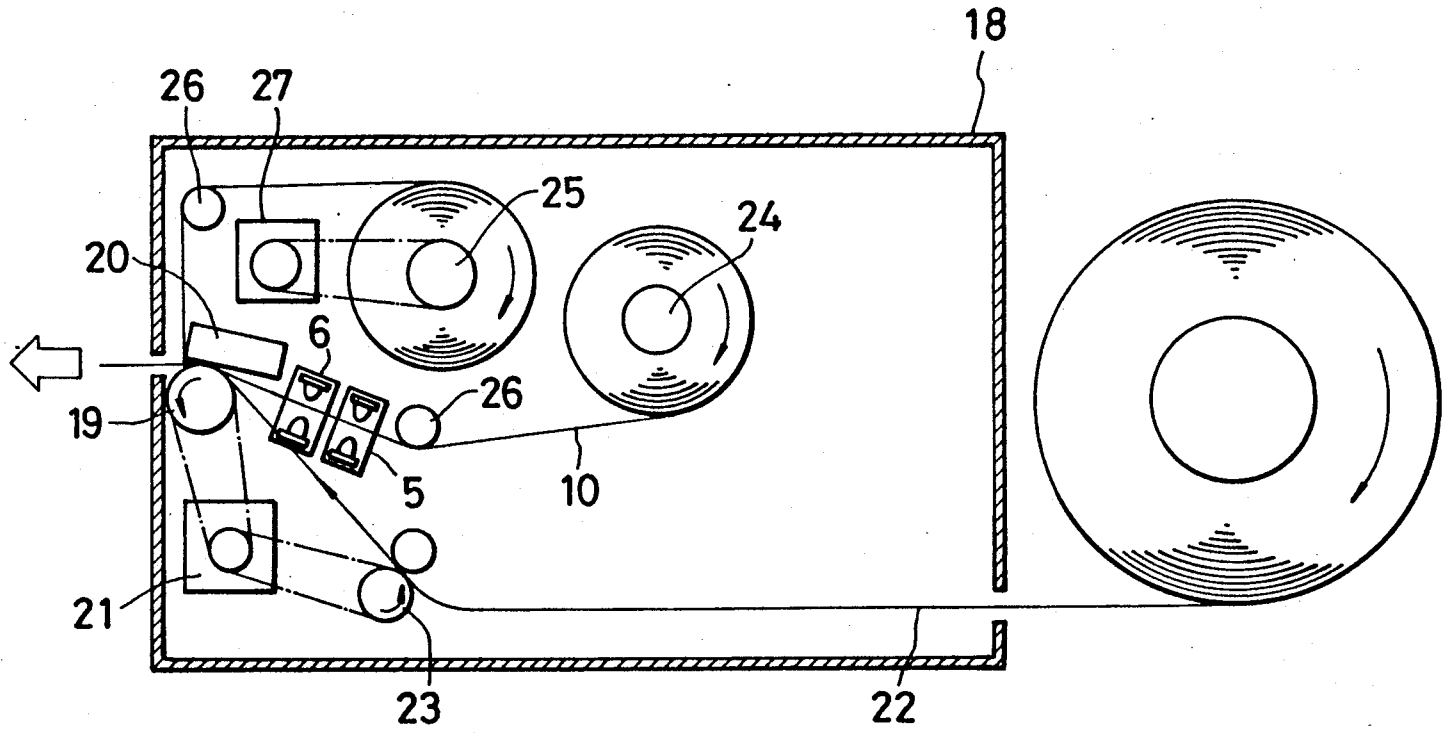
FIG. 4 is a vertical side view showing an example of a printer construction.

A first embodiment according to the present invention will be described based on FIG. 1 to FIG. 5. Incidentally, the description of the same parts as those of the above-mentioned conventional example is omitted using the same names and numerals. At first, a color discrimination apparatus 9 for a color ink ribbon according to the present embodiment is designed for a color printer. Discrimination marks 11 and 12 composed of straight lines of two kinds of one long and the other short are formed on a straight line at one edge of a color ink ribbon 10, and a stripe-shaped end mark 13 is formed at the end portion of the color ink ribbon. Here, the width of the color ink ribbon 10 is substantially equal to the length of line thermal heads (neither is shown), and the size of respective ink supply portions Y, M, and C is substantially equal to that of the blank. On the other hand, the optical sensors 5 and 6 are arranged in one straight line in the direction along which the above-mentioned color ink ribbon 10 moves and fixed integrally to a read-out head 14, a discrimination mark read-out means of this color discrimination apparatus 9 for a color ink ribbon. Here, the above-mentioned read-out head 14 is formed movably in the width direction of the above-said color ink ribbon 10, and the two optical sensors 5 and 6 are arranged opposite the discrimination marks 11 and 12. Furthermore, the output portions of the respective optical sensors 5 and 6 of the read-out head 14 are connected to a mark detection unit 15 and color decision unit 16. The color decision unit 16 is feedback-connected to a ribbon drive unit 17, a ribbon carrying means.

Next, FIG. 4 shows one example of a printer construction. A platen 19 and a printing head 20 undulatable for the platen 19 are disposed in the inside of a main-body case 18. The above-mentioned platen 19 is connected to a feed motor 21. The feed motor 21 is connected to a pair of feed motors 23 for driving a recording paper 22.

Further, the above-mentioned color ink ribbon 10 is wound on a supply shaft 24 and a paper winding shaft 25, and wound on two guide-rollers 26 and led around necessary places. In other words, the color ink ribbon 10 passes together with the above-mentioned recording paper 22 between the above-mentioned platen 19 and the above-mentioned printing head 20, and the above-mentioned optical sensors 5 and 6 are located just in front of the passage and disposed. Moreover, a ribbon motor 27 is connected to the above-mentioned paper winding shaft 25.

Figure 5:
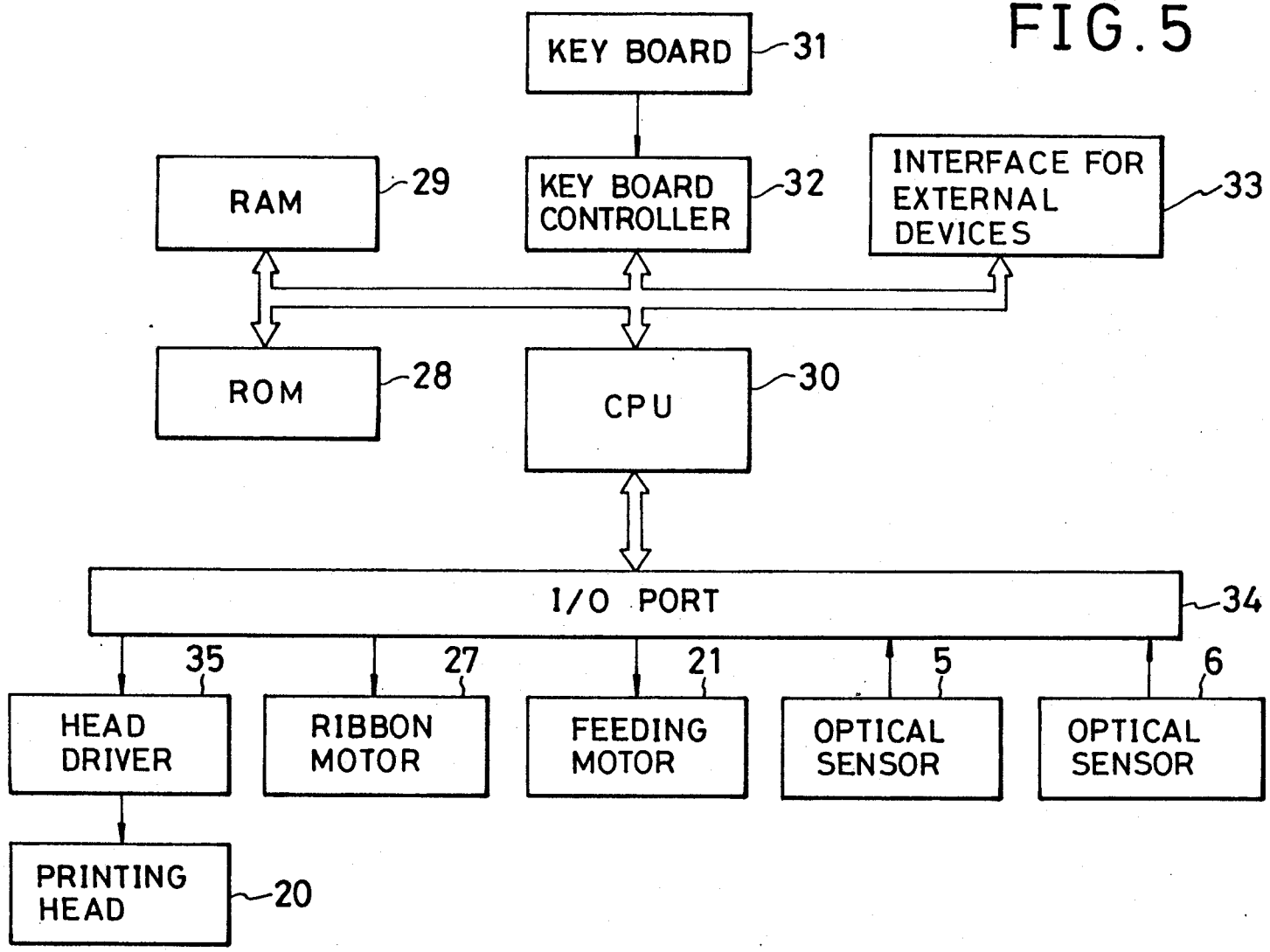
FIG. 5 is a block diagram of internal circuits.
Figure 9:
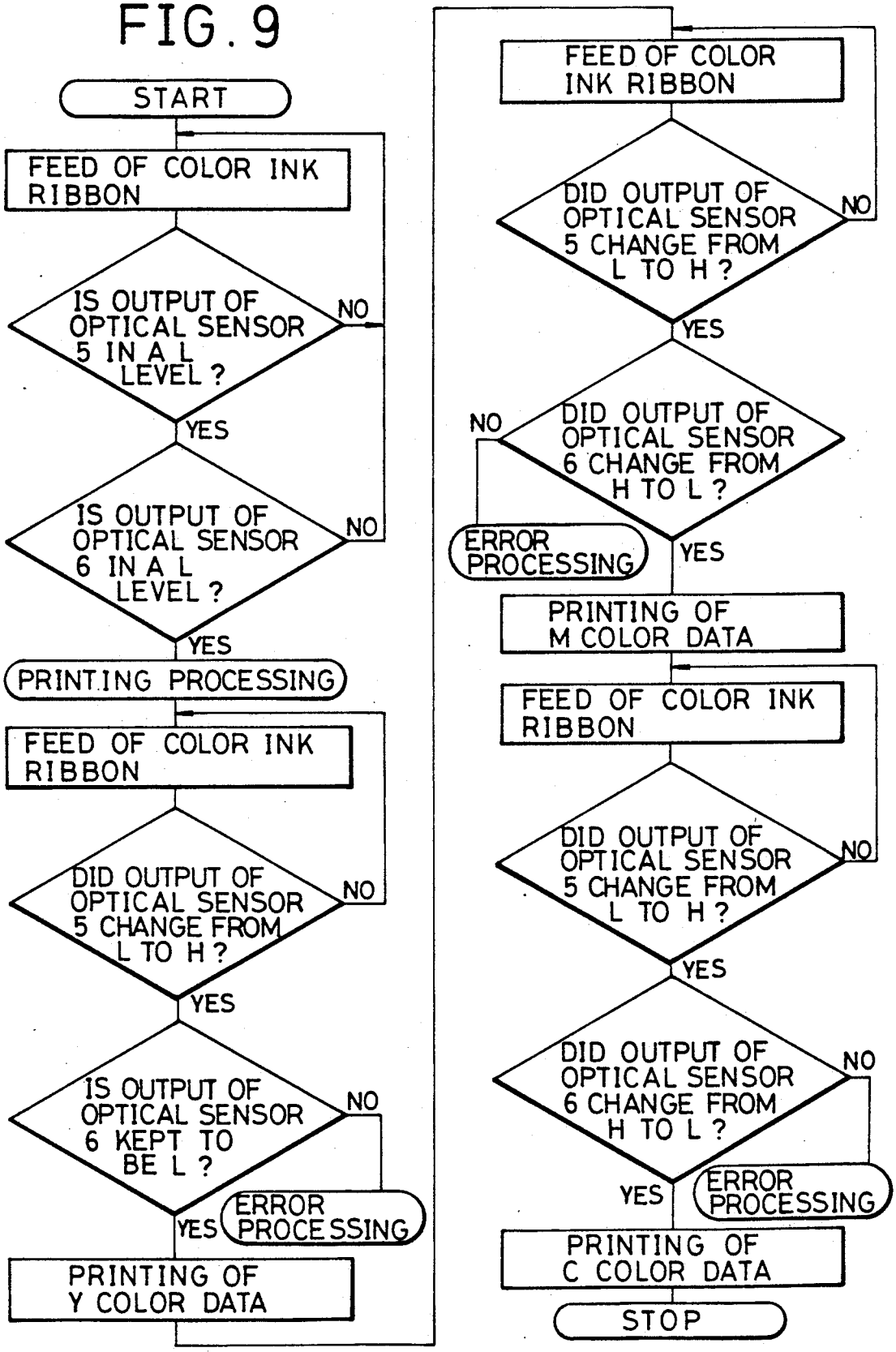
FIG. 9 is its flowchart.
Figures 10, 11:
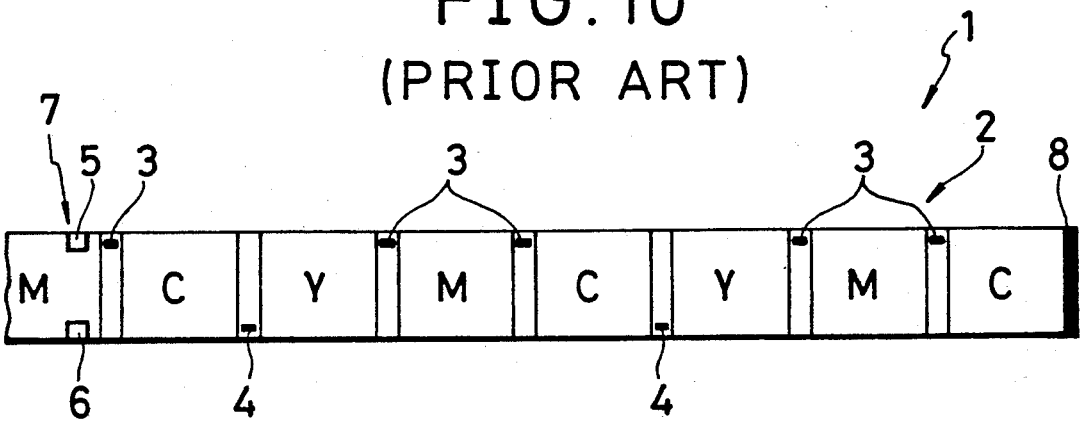
FIG. 10 (PRIOR ART)
FIG. 11 (PRIOR ART)
FIG. 10 is an explanatory diagram showing one example of a conventional example.
FIG. 11 is an explanatory diagram of prior art read-out operation.

Next, internal electrical circuits are formed as shown in FIG. 5. At first, a keyboard controller 32 for a keyboard 31, an interface 33 for external devices, and an I/O port 34 are connected to a CPU 30 to which a ROM 28 and a RAM 29 having a memory domain for the outputs of the optical sensors are connected. A head driver 35 to which the above-mentioned printing head 20 is connected, the above-mentioned ribbon motor 27, the above-mentioned feed motor 21, and the above-mentioned optical sensors 5 and 6 are connected to this I/O port 34.

With such the constitution, in this color discrimination apparatus 9 for a color ink ribbon, for example, the output value of the optical sensor 6 is detected when the output value of the optical sensor 5 is varied like L→H, and the output value and the output value in the detection at the preceding time are compared with each other to discriminate colors of the ink supply portions Y, M, and C. In short, as shown in FIG. 3, the output value of the optical sensor 6 immediately after the discrimination mark 11 passes in front of the optical sensor 5 as the color ink ribbon 10 moves from the right to the left is L, and it is recognized that the ink supply portion Y abuts on the line thermal head under the condition that the output values at the preceding time is H. Next, the output value of the optical sensor 5 when the discrimination mark $12_1$ passes in front of the optical sensor 5 is H. Here, since the output value of the optical sensor 6 when the ink supply portion Y is detected is L, the change in the output value is like L→H, and the ink supply portion M is detected. Furthermore, since the output value of the optical sensor 6 when the discrimination mark $12_2$ passes in front of the optical sensor 5 also is H, this change in output value is like H→H, and the ink supply portion C is detected. Moreover, in the color discrimination apparatus 9 for a color ink ribbon, when the end mark 13 reaches the read-out head 14, the output value of the discrimination mark read-out means 14 repeats L→H, and the ribbon end is detected, thereby stopping devices.

Moreover, in the color discrimination apparatus 9 of a color ink ribbon according to the present embodiment, since the two optical sensors 5 and 6 are fixed integrally to the read-out head 14, no error occurs in the relative position of the respective optical sensors 5 and 6, and moreover, since the discrimination marks 11 and 12 are formed at one edge of the color ink ribbon 10, the position adjustment of the read-out head 14 is very easy in the case where an ink ribbon different in width from that of a conventional one is employed.

Next, a second embodiment according to the present invention based on FIG. 6 to FIG. 9 will be described. In the second embodiment is utilized the fact that if the position of Y become known, the positions of M and C can be detected by only their head projections because the colors of the color ink ribbon 10 in the present embodiment are arranged in the order of the ink supply portions Y, M, and C. For this, two kinds of discrimination marks 36 and 37 are prepared. The length of the discrimination mark 37 for M and C among these marks is set so as to coincide with the interval D between the two optical sensors 5 and 6, and the length of the discrimination mark 36 is set so as to be longer by a measure h than the interval D of the two optical sensors 5 and 6.

With such an arrangement the ink ribbon feed is carried out. The optical sensor 5 detects the discrimination marks 36 and 37, and its output becomes L level. When the output of the other optical sensor 6 becomes L level, the printing processing is carried out. In the process, the head projection of Y is carried out as follows. In other words, the change in the output of the optical sensor 6 at the instant when the output of the optical sensor 5 changes from L to H is observed. If the change in the output of the optical sensor 6 is always L, the color ink ribbon 10 is in the state that it proceeds by a measure h to the left from the state shown in FIG. 6. The projection is, therefore, recognized to be that of Y, and the Y printing processing is carried out. When the printing using one color is completed, the printing head 20 rises and a recording paper 22 is subjected to backfeed by one color.

At the same time, the color ink ribbon 10 is sent forwardly, and the change in the output of the optical sensor 6 is observed when the output of the optical sensor 5 changes from L to H. In this case, the output of the optical sensor 6 changes from H to L as shown in FIG. 7. Since the change is one of the first time after the Y printing, it means the head projection of M. In this state, the printing head 20 falls and carries out the M printing. Similarly in the above-mentioned case, the recording paper 22 is subjected to backfeed after the printing to carry out the same detection. If the output of the optical sensor 6 changes from H to L when the output of the optical sensor 5 changes from L to H, the change is second one. Accordingly, the head projection of C is carried out, and the C printing is performed. In this way, the three color printing is completed.

What is claimed is:

1. A color discrimination apparatus for a color ink ribbon which comprising:

a long and narrow color ink ribbon in which ink supply portions of respective colors are repeatedly formed with the same arrangement;

a ribbon carrying means which moves the color ink ribbon on its lengthwise direction;

discrimination marks which are parallel to the lengthwise direction of said color ink ribbon, wherein the length of each of said marks is indicative of a respective color of said ink supply portions, and said marks are positioned on the same straight line and formed at one edge of said color ink ribbon; and a discrimination mark read-out means which is located at the position opposite the discrimination marks and provided with two optical sensors arranged on a straight line in the direction along which said color ink ribbon moves.

2. The color discrimination apparatus for a color ink ribbon according to claim 1, wherein a discrimination mark of which length is longer than the measure of the interval of two optical sensors and a discrimination mark of which length is not less than the measure of the interval of the two optical sensors are employed.

3. The color discrimination apparatus for a color ink ribbon according to claim 1, wherein two optical sensors are fixed integrally to a read-out head.

4. The color discrimination apparatus for a color ink ribbon according to claim 1, wherein a stripe-shaped end mark is formed at the end portion of a color ink ribbon.

5. The color discrimination apparatus for a color ink ribbon according to claim 1, wherein the color discrimination is carried out by a state of a change in an output of the other optical sensor when a state of an output of one optical sensor changes.

6. The color discrimination apparatus for a color ink ribbon according to claim 1, wherein a color ink ribbon has sections arranged in the order of Yellow, Magenta, and Cyan.

7. The color discrimination apparatus for a color ink ribbon according to claim 2, wherein the color detection is begun after two optical sensors simultaneously have detected a discrimination mark of the length longer than the interval of the two optical sensors.

8. The color discrimination apparatus for a color ink ribbon according to claim 2, wherein an output of the other optical sensor is stored when an output of one optical sensor changes and next, an output of the other optical sensor is compared with the output value of the other optical sensor which has been already stored when an output of one optical sensor changes, thereby carrying out the color discrimination.

9. The color discrimination apparatus for a color ink ribbon according to claim 5, wherein a color is discriminated from a first color in the case where an output of the other optical sensor does not change when an output of one optical sensor has changed.

* * * * *